US007096817B1

(12) United States Patent
Scadden

(10) Patent No.: US 7,096,817 B1
(45) Date of Patent: Aug. 29, 2006

(54) PONTOON CRAFT

(76) Inventor: Dave Scadden, 6085 N. 2250 East, Liberty, UT (US) 84310

( * ) Notice: Subject to any disclaimer, the term of this patent is extended or adjusted under 35 U.S.C. 154(b) by 0 days.

(21) Appl. No.: 11/065,713

(22) Filed: Feb. 25, 2005

(51) Int. Cl.
*B63B 17/00* (2006.01)

(52) U.S. Cl. ..... 114/363; 114/61.25

(58) Field of Classification Search ..... 114/362, 114/363, 61.25
See application file for complete search history.

(56) References Cited

U.S. PATENT DOCUMENTS 4,971,315 A * 11/1990 Rector ..... 482/30
5,085,165 A * 2/1992 Reed ..... 114/362
6,227,790 B1 * 5/2001 Mollick et al. ..... 414/541
6,640,741 B1 * 11/2003 Myers ..... 114/352

* cited by examiner

*Primary Examiner*—Stephen Avila

(57) ABSTRACT

A watercraft of the "float boat" type, including spaced apart inflatable pontoons interconnected by a platform structure having a chair thereon and a front ramp and support rail movable between a stowed out-of-the way position to a use position and including a removable wheel for moving the float boat over land.

8 Claims, 4 Drawing Sheets

PONTOON CRAFT

CROSS-REFERENCE TO RELATED APPLICATIONS

Figure 1:
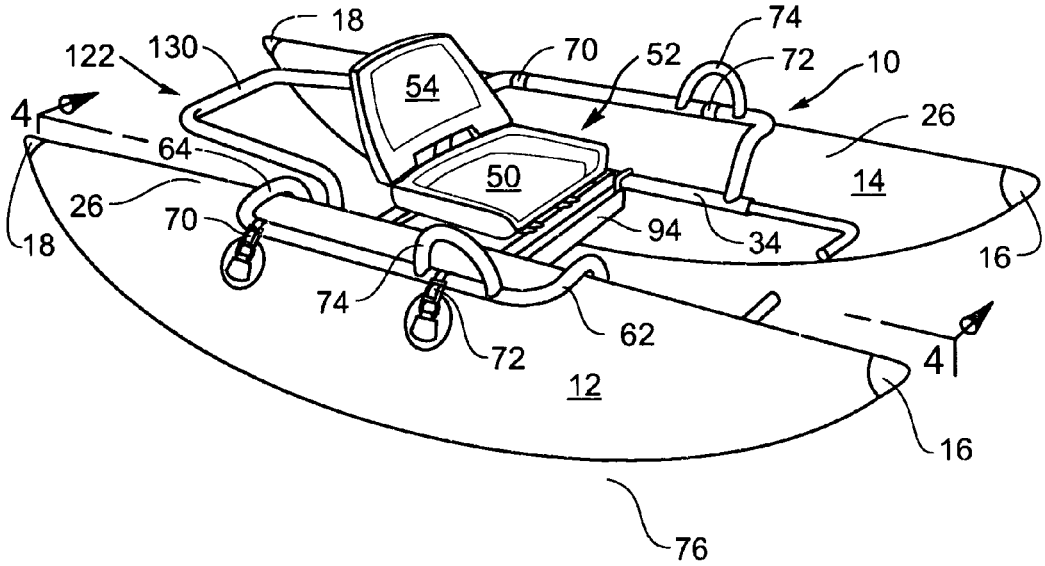

Not Applicable.

STATEMENT REGARDING FEDERALLY SPONSORED RESEARCH OR DEVELOPMENT

Not Applicable.

REFERENCE TO MICROFICHE APPENDIX

Not Applicable.

BACKGROUND OF THE INVENTION

1. Field of the Invention

This invention relates to pontoon craft and particularly to such craft as are commonly referred to as "float boats". Lightweight pontoon boats of the type known generally as float boats, with inflatable pontoons have become increasingly more popular for use by fishermen and others. Float boats are smaller and lighter in weight than many other types of watercraft and are more easily handled by a single individual during launching, retrieval and use on water.

Float boats are often propelled using oars, or by kicking of the wader covered feet of a user, or by both feet movement and oar operation.

2. Prior Art

Existing float boats generally include a pair of spaced apart inflatable pontoons interconnected by a platform structure. The pontoons are air filled and usually constructed as reinforced, rubberized tubes, with upturned front and rear ends.

The platform structure supports a chair, including a seat upon which a user sits and a seatback for supporting the back of a user. The seatback may pivot to fold down over the seat when the watercraft is not in use, or the seatback can be rigidly attached to the seat.

BRIEF SUMMARY OF THE INVENTION

Objects of the Invention

Principal objects of the present invention are to provide a float boat that is light in weight, easily transported and used by a single individual, and that is readily used on rivers, lakes, ponds and the like.

Other objects are to provide a float boat that is relatively inexpensive and that will provide a standing platform for a fisherman and a support rail to prevent the standing fisherman falling from the craft when it is on the water.

Still another object is to provide a float boat that can be easily rolled to the water edge and launched, or that can be retrieved and easily rolled from the water edge.

Features of the Invention

Principal features of the invention include a pair of spaced apart float tubes shaped as pontoons, with front and rear pointed ends and a platform structure interconnecting the pontoons and including a chair for a user. The chair includes the usual seat and seatback. A foot ramp pulls from beneath the seat to be used as a standing platform. A support rail swings from a position behind the chair and between the pontoons to a secured upright position, forward of the chair, as a support and safety rail for a fisherman user who is fishing while standing on the ramp.

The platform structure is readily attached to and disconnected from the pontoons and further includes a receiver into which a wheel can be connected during transportation of the watercraft over land, as it is launched onto and retrieved from water.

Adjustable footrests extend forwardly from the platform structure so that a fisherman, sitting on the chair can comfortably rest his feet. The footrests further serve as handles when the wheel is attached to the platform and the float boat is wheeled to or away from water edge.

Additional objects and features of the invention will become apparent to persons skilled in the art to which the invention pertains from the following detailed description and claims.

BRIEF DESCRIPTION OF THE FIGURES OF THE INVENTION

In the Drawings

Figure 2:
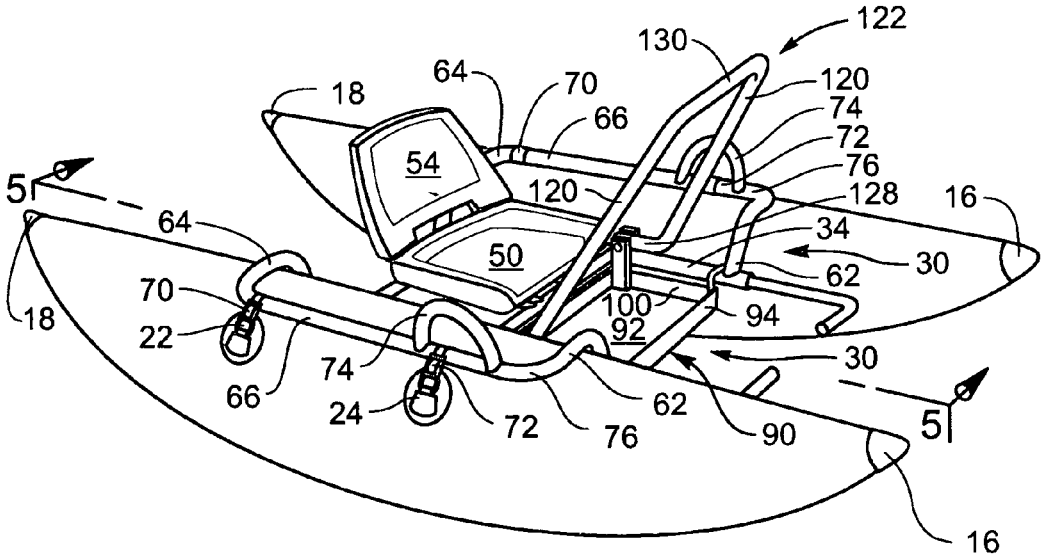
Figure 3:
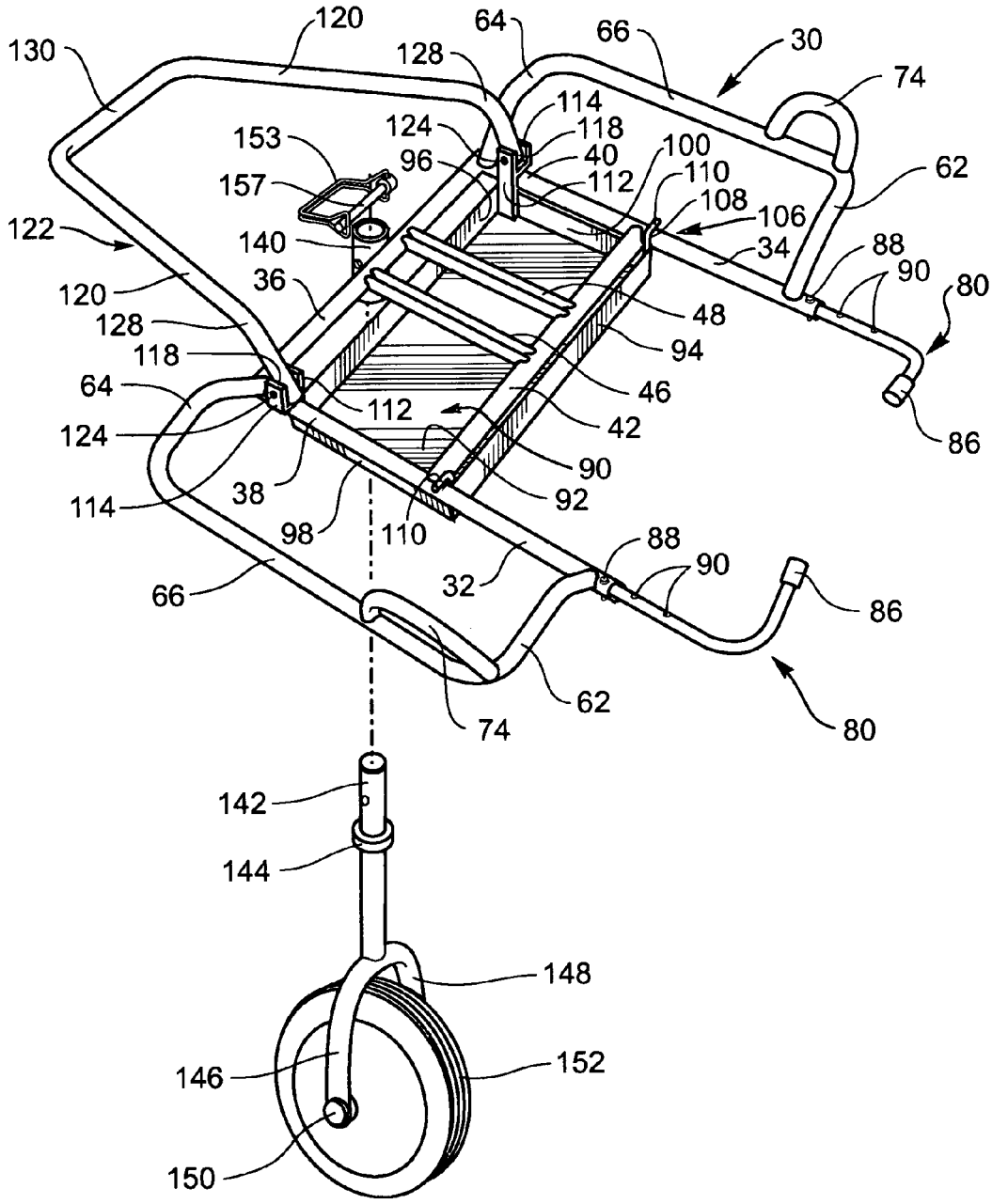
Figure 4:
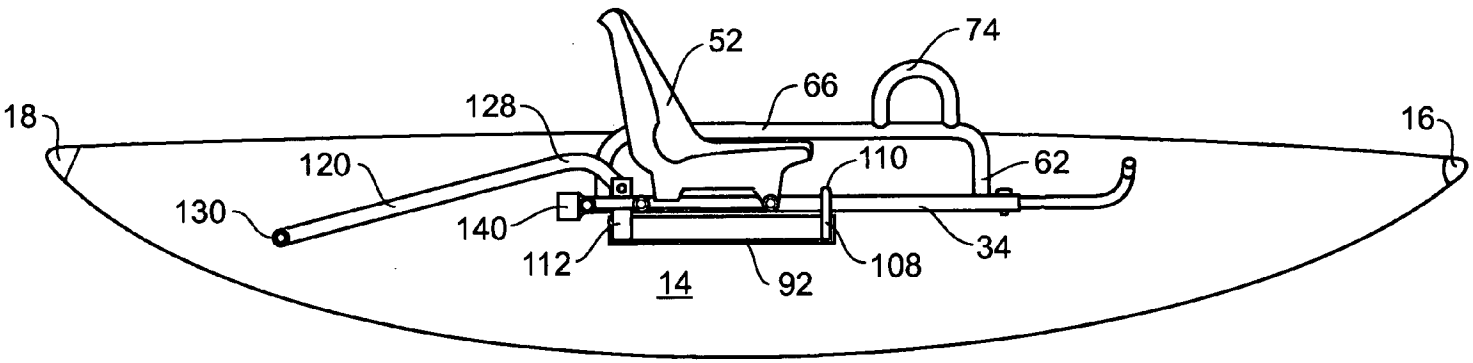
Figure 5:
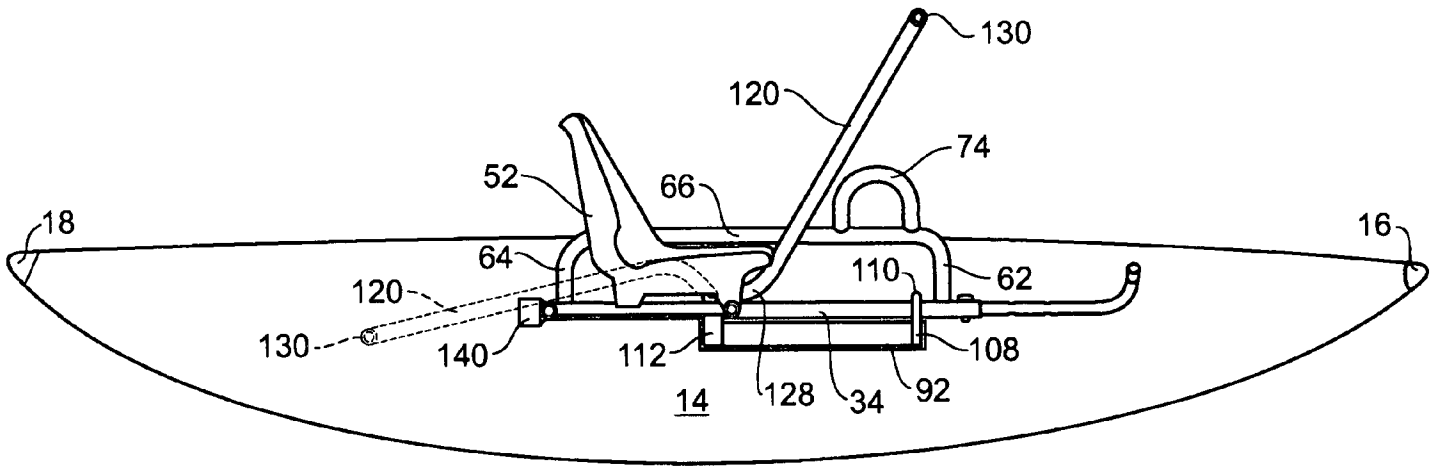
Figure 6:
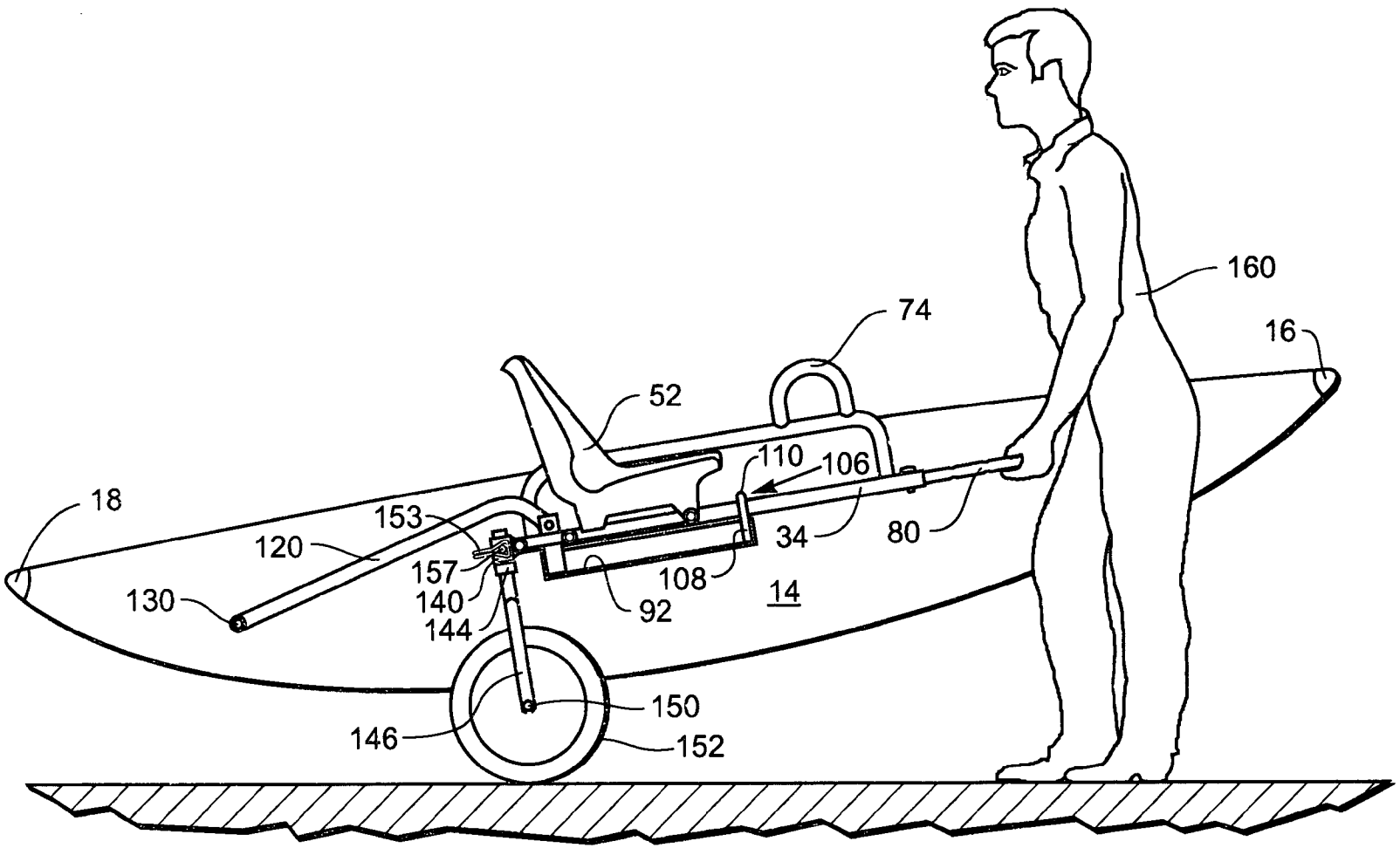

FIG. 1 is a perspective view of a float boat pontoon craft of the invention, with the support rail and foot ramp in stowed position;

FIG. 2, a view like that of FIG. 1, but showing the support rail and foot ramp moved to a use position;

FIG. 3, an enlarged perspective view of the platform structure, with the wheel shown exploded;

FIG. 4, a view taken on the line 4—4 of FIG. 1;

FIG. 5, a view like that of FIG. 4, but taken on the line 5—5 of FIG. 2; and FIG. 6, a view like that of FIG. 4, but showing the wheel in place and a person transporting the float boat.

DETAILED DESCRIPTION

Referring Now the Drawings

In the illustrated preferred embodiment the "float boat" type of watercraft of the invention is shown generally at 10.

Float boat 10 includes a pair of spaced apart pontoons 12 and 14. Each pontoon includes an upturned, pointed front end 16 and an upturned, pointed rear end 18. The pontoons 12 and 14 are each air-filled and are generally manufactured from a durable flexible sheet material that will contain air inside. Reinforced neoprene rubber or other rubberized materials have been found suitable for the purpose. Such pontoons are conventional and are available commercially. A pair of attachment rings 22 and 24 are spaced apart along the length of the outer and upper surface 24 of each pontoon. The rings are vulcanized, bonded, or otherwise secured to the surfaces 26 of the pontoons 12 and 14.

A platform structure, shown generally at 30 is connected between pontoons 12 and 14. Platform structure 30 includes a pair of spaced apart tubular side rails 32 and 34 interconnected by a brace 36. Brace 36 is wielded or otherwise affixed to the ends 38 and 40 of the spaced apart tubular rails 32 and 34, respectively.

Another brace 42 extends parallel to the brace 36 and interconnects the rails 32 and 34 intermediate their lengths.

Parallel chair support braces 46 and 48 extend between the braces 36 and 42 and are respectively spaced on opposite sides of the centers of the braces 36 and 42.

The seat 50 of a chair, shown generally at 52 is bolted or otherwise affixed to the seat support braces 46 and 48. Chair 52 also includes a seatback 54.

The tubular side rail 32 and 34 each have a support frame 58 and 60, respectively, secured thereto. Each support frame 58 and 60 has a pair of spaced apart arms 62 and 64 interconnected by a rail 66. The arms 62 and 64 are curved to extend from a side rail 32 or 34 upwardly and over the top of a pontoon 12 or 14.

Spaced apart straps 70 and 72 wrap around each rail 66 and through a ring 22 or 24 to secure the platform structure 30 to the pontoons 12 and 14.

A standing loop 74 is fixed to and projects upwardly from each rail 66 at a forward end 76 of the rail 66. The loops 74 each serve as a retainer for a handle of an oar (not shown) used to propel and guide the float boat 10.

Each of the side rails 32 and 34 has a foot rest 80 projecting from a front end thereof. Each footrest is L-shaped, with a long leg 82 telescoped into the end of rail 32 or 34. The other legs 84 of the footrests 80 are inturned and capped at 86 to serve as footrests for a user sitting on chair 52. A spring detent 88 on each of the forward ends of the rail 32 or 34 snaps into a selected one of holes 90 provided in the legs 82 to lock the footrests 80 in a selected extended use position.

A sliding standing ramp 90 is stowed beneath chair 52 and will pull out from beneath the chair to serve as a standing area for a user of the float boat 10.

Standing ramp 90 has a floor 92 surrounded by parallel front and rear upstanding walls 94 and 96 and parallel sidewalls 98 and 100 that interconnect the appropriate ends of the front and rear walls 94 and 96.

A hanger 106 is provided at the intersection of front wall 94 and each of the sidewalls 98 and 100. Each hanger 106 is L-shaped and includes a leg 108 connected to a sidewall 98 or 100 and a leg 110 that extends over a side rail 32 or 34.

An upstanding side plate 112 is provided at the intersection of rear wall 96 with each of the sidewalls 98 and 100. Each sidewall plate 112 extends upwardly from a sidewall 98 or 100 and has an upstanding ear 114 spaced from the upper end by a spacer 116 that rests on a side rail 32 or 34. Legs 110 and spacers 116 slide on side rails 32 and 34 as standing ramp 90 is pulled from beneath or pushed beneath chair 52.

Spaced apart ends 118 of legs 120 of support rail, shown generally at 122, are each journalled on a pivot pin 124 extending between an upper end of the side plate 112 and associated upstanding ear 114. The legs 120 of support rail 122 are ach curved at 128 and the legs are interconnected by a web 130.

A tubular receiver 140 is fixed to brace 36, intermediate the length of the brace. One end of a shaft 142 telescopes into socket 140 and the shaft projects downwardly from the receiver. A collar 144 on the shaft 142 limits the extent to which the shaft 142 will extend into socket 140. Bifurcated legs 146 and 148 extend downwardly from opposite sides of the shaft 142. An axle bolt 150 extends through the legs 146 and 148 and centrally through a wheel 152.

In use, the shaft 142 is inserted upwardly into receiver 140 until collar 144 engages the receiver. The wheel 152 then engages the ground when a user 160 grasps footrests 80, between the pontoons 12 and 14. A tether 153 has one end fitted onto a pin 155. The other end of the tether includes a stretch loop 157. Pin 155 is inserted through holes in receiver 140 and shaft 152 and through loop 157 to lock the shaft in the receiver. Wheel 52 rotates on bolt axle 150. The wheel 152 functions as a wheelbarrow wheel and is guided by the user 160 holding footrests 80 as the float boat 10 is rolled to a water edge, or is retrieved and wheeled away from water edge. At waters edge, the wheel is removed and the float boat is launched. Similarly, the float boat is removed from water and the wheel is connected to receiver 140 so that the float boat can be wheeled away from the water.

After launching of the float boat, a user will sit on chair 152, propelling and directing the float boat using feet and/or oars. The user, of course, may fish while sitting in chair 52, if he so desires.

If the user decides to fish from a standing position, he pulls the foot ramp 90 from beneath chair 52. As the foot ramp moves forward the support rail 122 is also pulled forward. When the foot ramp is pulled fully forward the support rail 122 is pivoted from its stowed position extending rearwardly of the seat 152, over the chair 52, to a use position wherein the curved portions 128 of the legs 120 of the support rail 122 will rest on side rails 32 and 34. The support rail 122 then provides support for a user standing on the floor 92 of foot ramp 90 while fishing, for example.

Although a preferred embodiment of my invention has been herein described, it is to be understood that the present disclosure is by way of example and that variations are possible without departing from the subject matter coming within the scope of the following claims, which subject matter I regard as my invention.

I claim:

1. A float boat comprising a pair of spaced apart, inflatable pontoons;

a platform structure extending between and secured to each of said spaced apart pontoons;

a chair mounted on said platform structure;

a standing ramp movable from a stowed position beneath the chair to a use position projecting forwardly of said chair; and a support rail movable from a stowed position behind the chair to a use position forwardly of said chair and above the standing ramp when said standing ramp is in use position.

2. A float boat as in claim 1, further including a pair of footrests each projecting forwardly of an opposite side of the platform structure.

3. A float boat comprising a pair of spaced apart, inflatable pontoons;

a platform structure extending between and secured to each of said spaced apart pontoons;

a chair mounted on said platform structure;

a standing ramp movable from a stowed position beneath the chair to a use position projecting forwardly of said chair; and a support rail movable from a stowed position behind the chair to a use position cantilevered forwardly of said chair and above the standing ramp when said standing ramp is in use position.

4. A float boat as in claim 3, where the support rail has legs pivotally connected to the standing ramp.

5. A float boat as in claim 4, wherein the legs of the support rail are curved to rest on the standing ramp when the support rail is moved to the use position.

6. A float boat as in claim 5, further including a receiver fixed to the platform structure intermediate between the floats; and a wheel assembly including a shaft projecting from said wheel to fit into said receiver.

7. A float boat as in claim 6, further including a pair of footrests each projecting forwardly of an opposite side of the platform structure.

8. A float boat comprising a pair of spaced apart, inflatable pontoons;

a platform structure extending between and secured to each of said spaced apart pontoons;

a chair mounted on said platform structure;

a standing ramp movable from a stowed position beneath the chair to a use position projecting forwardly of said chair;

a support rail movable from a stowed position behind the chair to a use position forwardly of said chair and above the standing ramp when said standing ramp is in use position;

a receiver fixed to the platform structure intermediate between the floats; and a wheel assembly including a shaft projecting from a wheel to fit into said receiver;

a pair of footrests each projecting forwardly of an opposite side of the platform structure;

the support rail has legs pivotally connected to the standing ramp; and wherein the legs of the support rail are curved to rest on the standing ramp when the support rail is moved to the use position.

* * * * *